US005234373A

United States Patent [19]

Yamazaki et al.

[11] Patent Number: 5,234,373

[45] Date of Patent: Aug. 10, 1993

[54] AIR CONDITIONER

[75] Inventors: Masaya Yamazaki; Kenichi Tomiyoshi, both of Shizuoka, Japan

[73] Assignee: Kabushiki Kaishi Toshiba, Kawasaki, Japan

[21] Appl. No.: 769,244

[22] Filed: Oct. 1, 1991

[30] Foreign Application Priority Data

Oct. 1, 1990 [JP] Japan ..... 2-260508

[51] Int. Cl.[5] ..... F24F 13/14

[52] U.S. Cl. ..... 454/319; 454/315; 454/318

[58] Field of Search ..... 454/258, 313, 315, 316, 454/318, 319, 320

[56] References Cited

FOREIGN PATENT DOCUMENTS 2-34941 3/1990 Japan .
2-67841 5/1990 Japan .
3-160267 7/1991 Japan ..... 454/316

*Primary Examiner*—Harold Joyce
*Attorney, Agent, or Firm*—Oblon, Spivak, McClelland, Maier & Neustadt

[57] ABSTRACT

An air conditioner is provided with a room unit which comprises a suction grille member mounted to the front panel of the room unit and a blow-off grille member mounted to the lower portion of the front panel. The blow-off grille member comprises two louvers turnable around axes thereof parallel to each other, a link mechanism operatively connected to the louvers so as to turn the louvers with different angles, rspectively. The link mechanism comprises a plurality of link members, for example a five-knot link mechanism, which are turnably coupled with each other and a driving motor for driving the link mechanism to thereby turn the louvers with different air blow-off open angles, respectively. An operation mode transfer member may be further provided for the blow-off grille member to transfer the operation mode of the louvers.

5 Claims, 6 Drawing Sheets

AIR CONDITIONER

BACKGROUND OF THE INVENTION

The present invention relates to an air conditioner, particularly one having an air blow-off grille member of a room unit improved in its structure.

Generally, in an air conditioner, a turnable blow-off grille is provided on an air blow-off port of a room unit of the air conditioner and the direction in which air blows off can be controlled by changing an angle of the blow-off grille. For example, in a so-called rotary grille type air conditioner, a louver as one blow-off grille, turnable around its axis, is provided on an air blow-off port opened at a lower portion of a casing of the air conditioner.

There has also been provided an air conditioner of a type in which a plurality of blow-off grilles, i.e. lover panels, turnable around their axes and parallel with each other, are provided on an air blow-off port of a casing of the air conditioner and the blow-off grilles are turnable in the same direction and also at the same angle. In the air conditioner of this type, the blow-off grilles are not protruded from the air blow-off port in the casing, and so the air conditioner has a good outer appearance during the shutdown thereof.

In the conventional air conditioners of the types described above, however, since a blow-off opening area of the air is almost constant even if the inclination of the blow-off grille member is changed, the blow-off opening area is too large to obtain a desired air speed at the time, for example, of a moderate air conditioning operation. Thus, the quantity of air does not have a satisfactory to feel, an air conditioning effect is prevailing only at or around the area where the room unit is installed, and hence, room temperature is not distributed in good condition entirely.

At the time of a low load heating operation likewise, hot air does not reach a predetermined distance, and a so-called draft mode operation involving an ambient cold air may occur unexpectedly.

Furthermore, at the time of a high load operation, a blow-off area of the air becomes insufficient and noise due to air resistance may grow greater.

SUMMARY OF THE INVENTION

An object of the present invention is to substantially eliminate defects or drawbacks encountered in the prior art and to provide an air conditioner capable of adjusting air blow-off area in accordance with air blast temperature and quantity of the air blast, thus improving the temperature distribution in a room and reducing noise even in a large capacity air blow-off operation mode.

This and other objects can be achieved according to the present invention by providing an air conditioner provided with a room unit comprising an outer casing, a front panel mounted to a front portion of the casing, an air suction grille means mounted in front of the front panel, and a blow-off grille means mounted to a bottom of the casing in a vertical state and being continuous to the front panel, the blow-off grille means comprising a plurality of louvers turnable around axes thereof parallel to each other, a link mechanism operatively connected to the louvers so as to turn the louvers with different angles, rspectively, the link mechanism comprising a plurality of link members which are turnably coupled with each other and a driving motor for driving the link mechanism with to thereby turn the louvers different air blow-off open angles, respectively.

In preferred embodiments, the louvers comprises two louvers, one being a main louver and another being a sub-louver and the link mechanism comprises a five-knot link mechanism including a main link member, a sub-link member, a first coupling link member and a second coupling member, the main link member having one end connected to the main louver and another end turnably connected to one end of the first coupling link member, the first coupling link member having another end turnably connected to one end of the second coupling link member, the second coupling link member having another end turnably connected to one end of the sub-link member, the sub-link member having another end connected to the sub-louver.

An operation mode transfer means may be further provided for the grille means to transfer the operation mode of the louvers. The transfer means may be composed of a spring member having one end connected to the axis of the main louver and another end connected to a connecting portion between the first and second coupling link member. Otherwise, the transfer means may be composed of an engaging clutch member secured to a connecting portion between the main link member and the first coupling link member.

According to the air conditioner of the structure described above, the louvers of the grille means of the room unit is changed in plural operation modes having different turning direction with different angles by operating an improved link mechanism, so that the air blow-off area and air blast direction can be widely adjusted. Accordingly, for example, when the air conditioner is operated with a moderate mode, the louvers are turned so as to take a mode having a small air blow-off width with respect to the air blow-off direction to thereby make narrow the air blow-off area, thus blasting cooling or hot air far away, resulting in an improved room temperature distribution.

On the contrary, when the air conditioner is operated with the large capacity, the lovers are turned so as to take a mode having a large air blow-off area, thus reducing air resistance and hence decreasing noise generation.

DESCRIPTION OF THE PREFERRED EMBODIMENTS

In advance of the detailed description of the preferred embodiments according to the present invention, prior art will be first described with reference to FIGS. 12 and 13 for a better understanding of the present invention.

Figure 12:
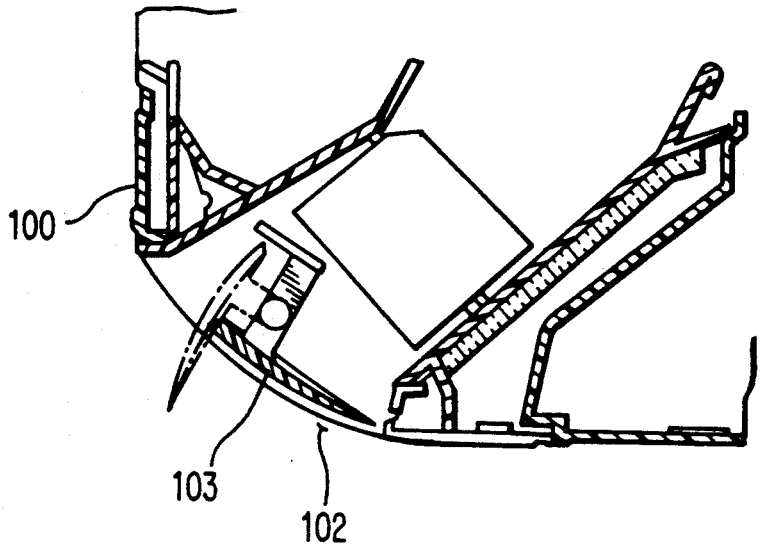
FIG. 12 PRIOR ART
FIGS. 12 and 13 are sectional views of a blow-off grille member of the prior room unit of an air conditioner.

Referring to FIG. 12 showing a rotary type air conditioner wherein a louver 103 as one blow-off grille turnable around its axis is provided on an air blow-off port 102 opened at a lower portion of a casing 100 of the air conditioner.

Figure 13:
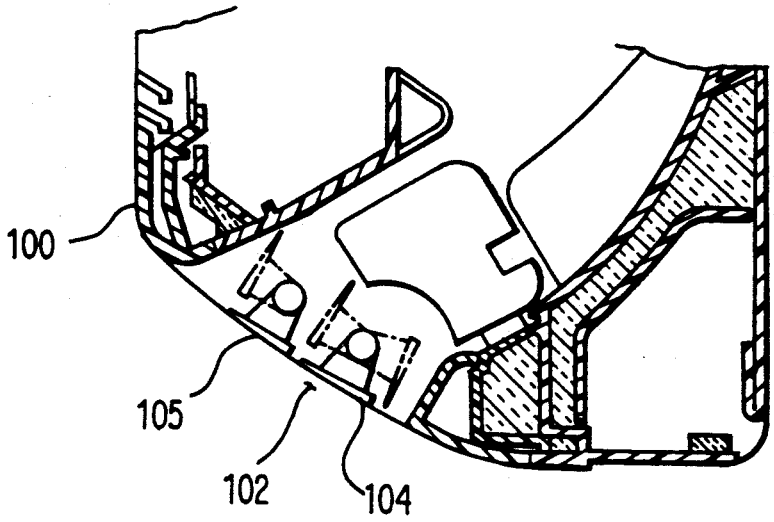
FIG. 13 PRIOR ART

FIG. 13 shows an air conditioner of a type in which a plurality of blow-off grilles 104 and 105, i.e. lover panels, turnable around their axes and parallel with each other are provided on an air blow-off port 102 of a casing 100 of the air conditioner and the blow-off grilles 104 and 105 are turnable in the same direction and also at the same angle. In the air conditioner of this type, the blow-off grilles 4 and 5 are rotated in the casing 100 and not protruded from the air blow-off port 102 of the casing 100, the air conditioner is kept nice in an outer appearance during the shutdown thereof.

However, these blow-off grille members of the air conditioners provide problems or disadvantages described hereinbefore.

The present invention conceived for substantially eliminating these problems or disadvantages will be described hereunder with reference to FIGS. 1 to 11.

Figure 1:
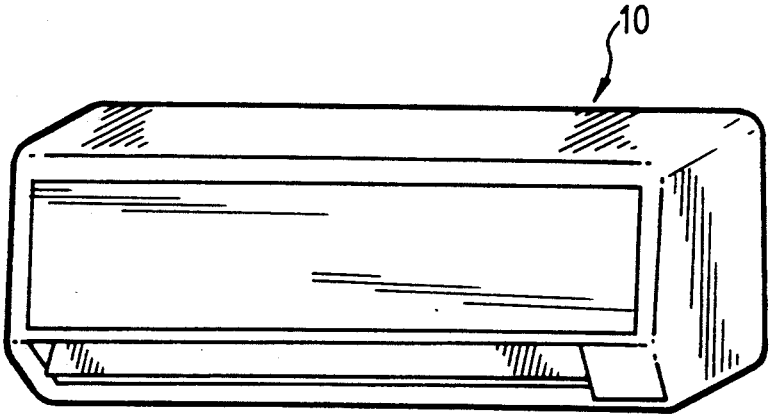
FIG. 1 is a perspective view of a room unit of an air conditioner to which the present invention is applied.
Figure 2:
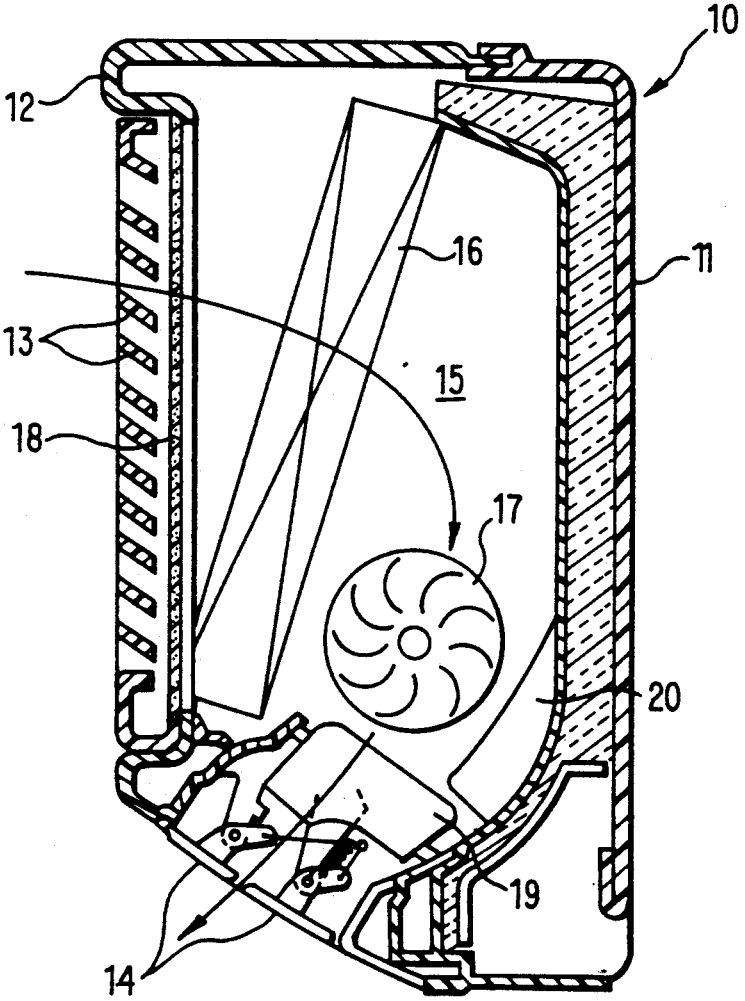
FIG. 2 is a sectional view of the room unit shown in FIG. 1.

FIG. 1 is a perspective illustration showing an outer appearance of an air conditioner of a wall type room unit 10 according to one kind of the present invention having an outer body casing 11 having substantially rectangular cross section as shown in FIG. 2.

FIG. 2 shows a cross section of the room unit 10 as air conditioner and the room unit 10 is provided with a front panel 12 mounted to the front portion of a body casing 11. Referring to FIG. 2, a suction grille member 13 is mounted on an upper portion of the front panel 12 and a blow-off grille member 14 is mounted on a lower portion thereof in a forwardly oblique fashion, the suction grille member 13 and the blow-off grille member 14 communicating with each other through a ventilation flue 15 formed within the body casing 11. The suction grille member 13 is composed of a plurality of louvers 13 and the blow-off grille member is composed of two louvers as described hereinafter.

There are disposed a room side heat exchanger 16 exchangeable of heat with room air and a room fan 17 consisting of a crossflow fan within the ventilation flue 15. An air filter 18 is disposed to the front panel 12 directly behind the suction grille member 13 and a wind vane 19 is also disposed within the ventilation flue 15 for horizontally guiding air ventilation. Reference numeral 20 denotes a straightening rib.

Figure 3:
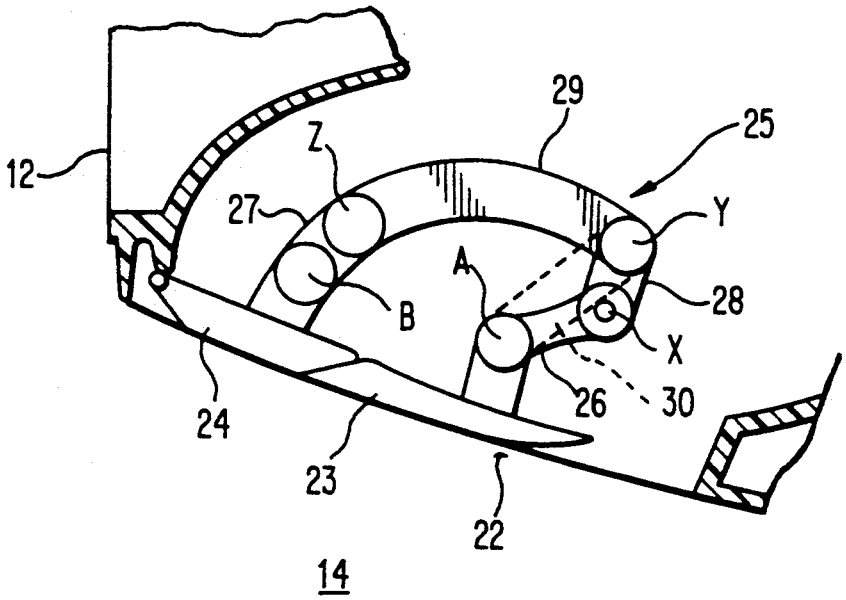
FIG. 3 is an illustration showing a mounting of a blow-off grille member of the room unit.
Figure 4:
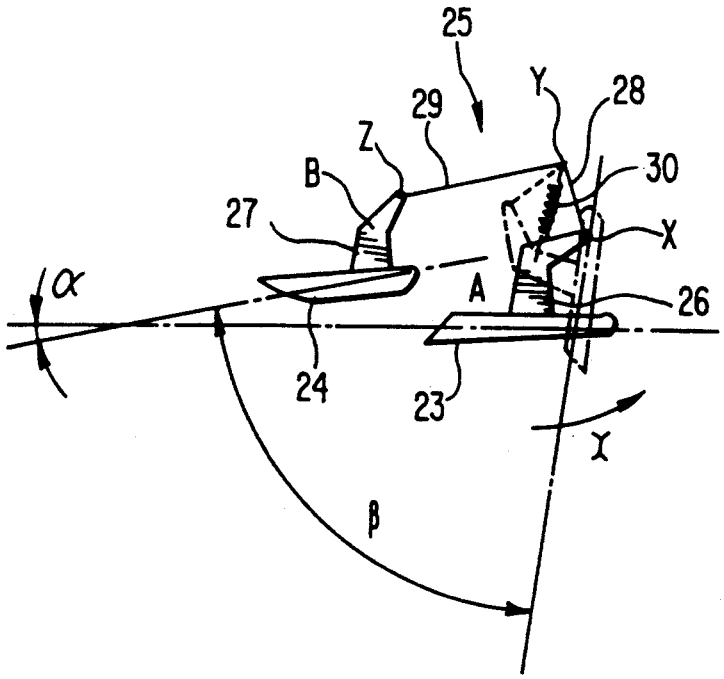
FIG. 4 is a conceptional drawing of FIG. 2 for the explanatory of the operation of the grille member.

FIG. 3 shows a construction of the blow-off grille member 14 of the room unit 10 concretely, and FIG. 4 shows the construction of the blow-off grille member 14 conceptually for the easy understanding of the operation thereof.

Referring to FIGS. 2 and 3, the blow-off grille member 14 is provided on an air blow-off port 22 at the lower portion of the front panel 12 of the casing 11 of the room unit 10 and the blow-off grille member 14 is provided with two louvers 23 and 24 which are turnable respectively around shaft centers, fixed shaft, A and B shifted longitudinally and vertically and parallel with each other. The louver 23 disposed lower rearward, as viewed in an installed state of the room unit 10, is operated as a main grille for the blow-off grille member 14 and the louver 14 disposed higher frontward is operated as a sub-grille therefor. The turning directions and turning angles of the louvers 23 and 24 are transferred in plural operation modes by a link mechanism 25 in accordance with a blow-off air temperature or a quantity of air.

Figure 11:
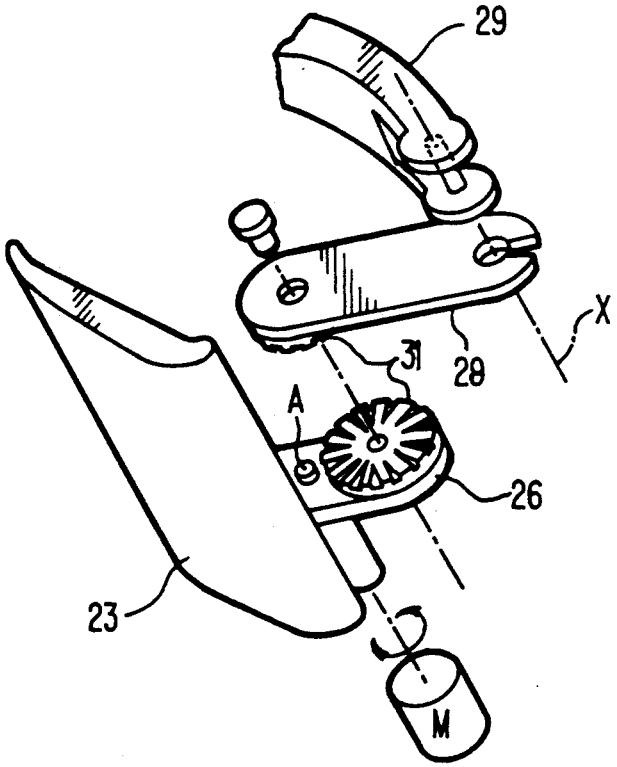
FIG. 11 is a perspective view showing another example of operation mode transfer means according to the present invention.

The link mechanism 25 operates by a single power source such as electric motor, which is not shown in FIG. 2 for the location of other members, but briefly shown in FIG. 11 in connection with the shaft A, and the link mechanism 25 comprises a five-knot link mechanism including a pluality of links 26, 27, 28 and 29 for coupling the louvers 23 and 24 together.

The one link 26 is protruded integrally with the main louver 23, thus being called main link 26 hereinafter. The other link 27 is protruded integrally with the sub-louver 24, thus being called sub-link 27 hereinafter. Furthermore, the other two links 28 and 29 are coupled with the main link 26, the sub-link 27, and therefore, the link 28 on the main link side is called first coupling link 28 and the link 29 on the sub-link side is called second coupling link 29. Both the coupling links 28 and 29 have other ends coupled turnably with each other.

The shaft A around which the main louver 23 turns is disposed at an almost intermediate portion of the main link 26 and the shaft B around which the sub-louver 24 turns is disposed at an intermediate portion of the sub-link 27. Each shaft need not necessarily come at the intermediate portion on the link side and may be provided on sides of the louver 23 or 24. Further, a nose, i.e. other end not coupled with the main louver, of the main link 26 and the first coupling link 28 are coupled turnably on a supporting point X, the first and second coupling links 28 and 29 are coupled turnably on a supporting point Y, and further the second coupling link 29 and a nose, i.e. other end not coupled with the sub-louver 24, of the sub-link 27 are coupled turnably on a supporting point Z.

Then, an arrangement is such that the first coupling link 28 and the second coupling link 29 move integrally with each other longitudinally or horizontally in FIG. 3 or 4 by the power source, thus turning the main louver 23 and the sub-louver 24 concurrently around the shafts A and B, respectively, through the main link 26 and the sub-link 27.

The first coupling link 28 is capable of turning independently around the supporting point Y with reference to the second coupling link 29. Further, the shaft center A for the main louver 23 to turn around and the supporting point Y are urged by a spring member 30 in the direction coming close to each other. Thus, as indicated by a full line and a virtual line in FIG. 4, the first coupling link 28 forms a toggle spring mechanism stabilized on opposite sides of a straight line connecting the shaft center A and the supporting point Y, thus realizing a transfer of two operation modes of the blow-off grille member 14 as described hereunder.

The first coupling link 28 is stabilized at a right side position indicated by the full line and a left side position indicated by the virtual line of the spring member 30, whereby the main louver 23 can be disposed selectively on those opposite positions. In the state of the full line, the relative angle of the main louver 23 and the sub-louver 24 becomes an open angle $\alpha$ getting gradually smaller in the blow-off direction. This is the first operation mode.

Then, in the state indicated by the virtual line, the relative angle of the main louver 23 and the sub-louver 24 becomes an open angle $\beta$ getting gradually larger in the blow-off direction. This is the second operation mode.

The operation mode of the air conditioner is transferred from the first mode to the second mode in the following manner.

That is, with the sub-louver 24 fixed, the main louver 23 is only turned counterclockwisely (in the direction indicated by an arrow x in FIG. 4) around the shaft center A by the driving of the motor. A link portion constructed by the main link 26 and the first coupling link 28 then shifts the position indicated by the virtual line against a tension of the spring member 30. In this case, the spring member 30 is functioned as a toggle spring due to its elasticity, therefore the link portion constructed by the main link 26 and the first coupling link 28 being retained stably at the position in the virtual line, and the main louver 23 stops at a position turned by the angle $\beta$ open large to the sub-louver 24.

Then, in order to transfer the operation mode from the second mode to the first, the main louver 23 may be turned clockwisely (in the direction counter to the arrow x in FIG. 4) around the shaft center A by the driving of the motor. The link portion constructed by the main link 26 and the first coupling link 28 is thus retained stably at the position in the full line by the operation of the spring member 30 functioning as a toggle spring, and the main louver 23 stops at a position turned by the angle $\alpha$ open small to the sub louver 24.

As described above, the blow-off area can be adjusted by selecting one of the first and second operation modes and the main louver 23 and the sub-louver 24 will be turned concurrently in the selected mode, thereby setting the blow-off area angle as well.

FIGS. 5 through 8 represent various states of the blow-off grille member according to the aforementioned construction.

Figure 5:
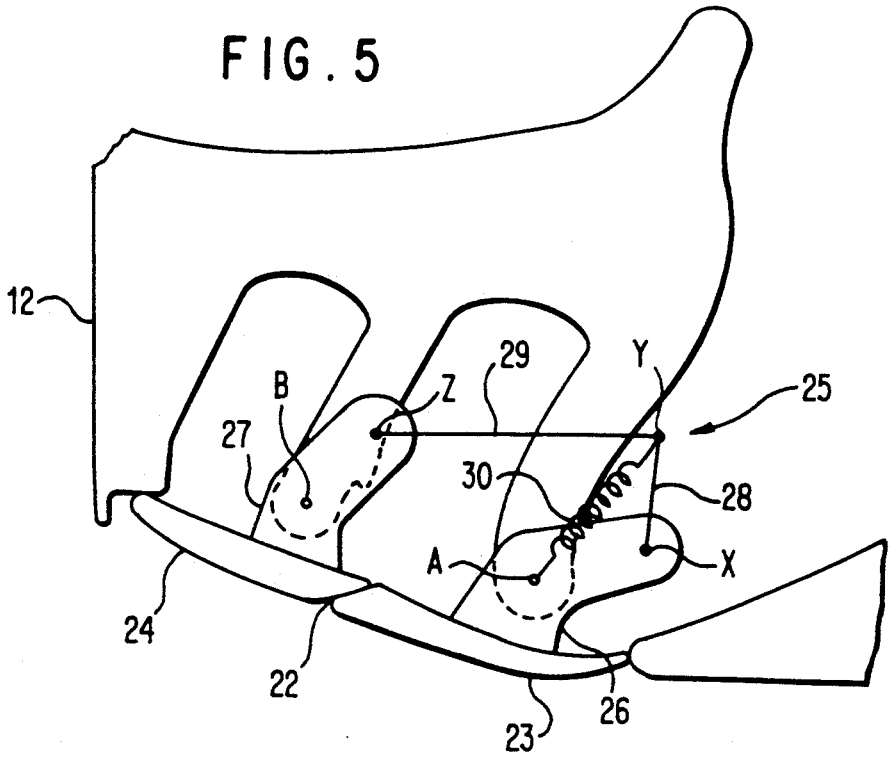
FIGS. 5 through 8 are views representing the various positions of the grille member taken during the air conditioning operation.

Namely, FIG. 5 represents the state where the main louver 23 and the sub-louver 24 are disposed on the same level by moving the second coupling link 29 rearward, i.e. rightward as viewed, in the first operation mode, thereby closing the blow-off port 2.

Figure 6:
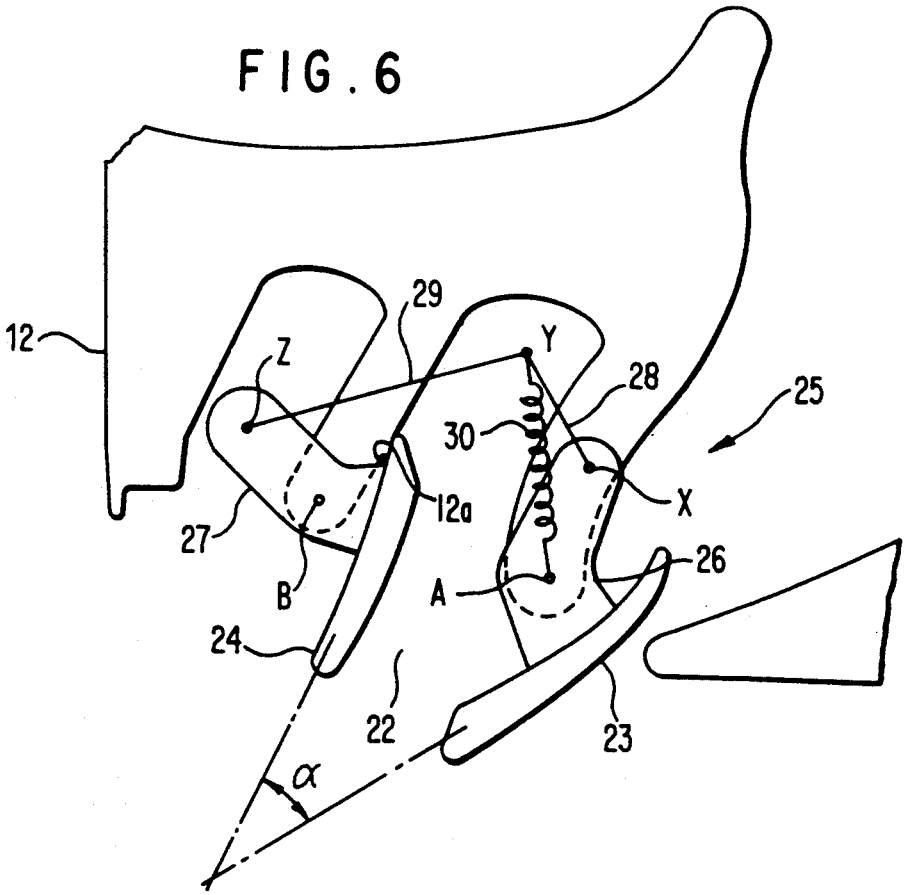

FIG. 6 represents the state where the main louver 23 and the sub-louver 24 are kept open by moving the second coupling link 29 forward, i.e. leftward as viewed, from the state shown in FIG. 5.

Figure 7:
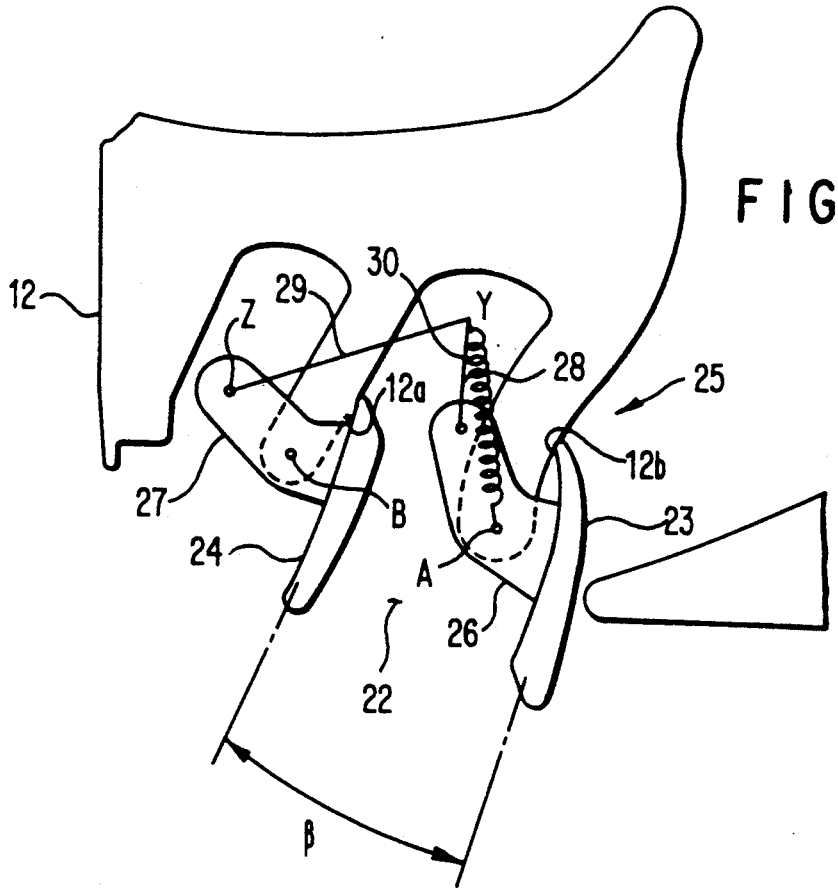

FIG. 7 represents the state where the operation mode is transferred to the second mode to enlarge the blow-off area. That is, the sub-louver 24 is kept in the state shown in FIG. 6 and the main louver 23 is opened further widely.

Figure 8:
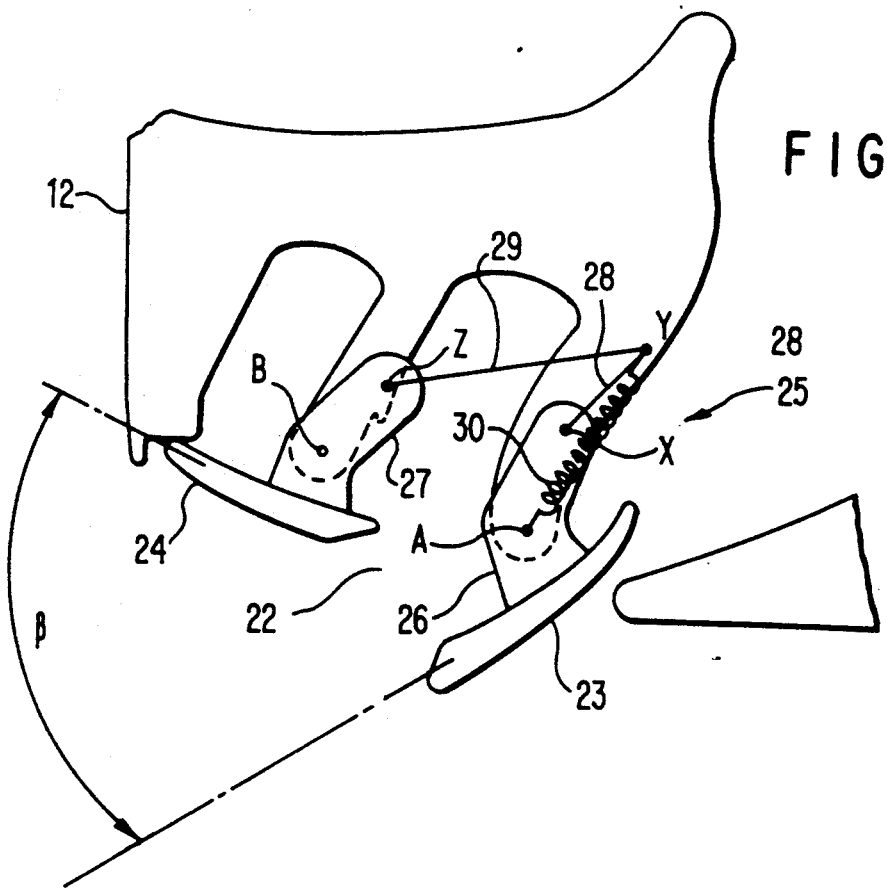

FIG. 8 represents the state where the sub-louver 24 is moved to the state shown in FIG. 5 and the main louver 23 is moved to the state shown in FIG. 6 with an open angle $\beta$.

Figure 9:
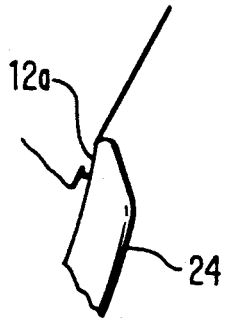
FIGS. 9 and 10 are fragmentary views of the blow-off grille member.
Figure 10:
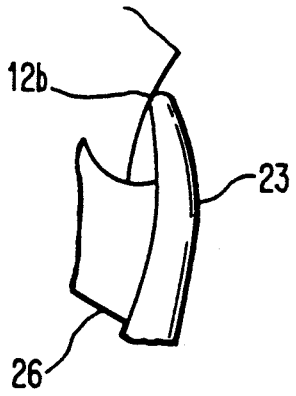

In this connection, FIGS. 9 and 10 exemplify a construction in which the main louver 23 and the sub-louver 24 are stopped and retained in abutment against the portions **12*b* and 12*a* of the front panel when the blow-off direction is set rearward maximumly in the state shown in FIG. 7, for example. As illustrated, the turning ranges of the main louver 23 and the sub-louver 24 are limited by bringing the front ends of the main louver 23 and the sub-louver 24 into contact with the fixed positions 12*a* and 12*b* of the front panel 12. However, it may be possible not to define the position 12*b* because the main louver 23 and the sub-louver 24 are moved in a predetermined manner and when the louver 24 contacts the portion 12*a*, the main louver 23** is also fixed in position.

According to this embodiment, at the time of the moderate operation of the air conditioner when a compressor capacity is small, for example, rising operation for heating, a heat exchange temperature is low, and hence, a blow-off temperature drops. It is therefore desirable that the blow-off temperature is raised by minimizing the quantity of air, however, an arrival distance of the air in the room will be shortened in this case. Therefore, the first operation mode is selected to reduce a grille opening area, thereby increasing the blow-off air arrival distance as shown in FIG. 6. Thus, the arrival distance of hot blast can be prolonged and a room temperature distribution will be improved. Further, it is conceivable that the quantity of the air is decreased by contracting the blow-off area likewise, thus a draft being lessened in feeling. Then, at a time of the air cooling operation, there may be a case where a cooling effect is spoiled under the state in which the heat exchange temperature is low, and therefore, a similar effect will be ensured by selecting the first operation mode.

On the other hand, at the time of the full operation, if the blow-off area is small on the contrary, an air resistance increases, thus a noise increases and the quantity of the air decreases, therefore the second mode being selected in this case to enlarge the blow-off area as shown in FIGS. 7 and 8. Therefore, an air resistance is decreased, a low noise operation is realized and the quantity of the air may be increased.

In the embodiment described above, the toggle spring mechanism is applied as a mode transfer means, however, the present invention is not limited thereto and various mechanisms may be applied. For example, as shown in FIG. 11, an engaging clutch member 31 engaging through a tongued-and-groved face may be applied to the supporting point X working as the coupling portion for the main link 26 and the first coupling link 28. According to such construction, the operation mode can be transferred by changing an engaging position of the clutch member 31 in various ways and a control width of the blow-off area can be further enlarged. The other constructional members and elements are not different from those of the first mentioned embodiment. In FIG. 11, the motor M is operatively connected to the shaft A, which may be applied to the former embodiment as mentioned before.

In other preferred embodiments, a friction resisting shaft may be applied to the supporting point X working as the coupling portion for the main link 26 and the first coupling link 28. In this case, each louver can be stopped at an arbitrary angle.

Furthermore, the main louver 23 may be coupled direct to a power source such as pulse motor or the like in construction, thereby realizing an automatic operation in combination with various sensors.

Still further, in the described embodiment, two grilles are provided for the blow-off grille member and the grilles are coupled with each other by five-knot link mechanism, but another construction may be employed such that more than two grilles are provided for the blow-off grille member and adjacent grilles are coupled with each other by the five-knot link mechanism or other ends of the coupling links coupled to each louver are coupled together.

It is to be understood that the present invention is not limited to the described embodiment and many other changes and modifications may be made without departing from the scope of the appended claims.

What is claimed is:

1. An air conditioner provided with a room unit comprising an outer casing, a front panel mounted to a front portion of the casing, an air suction grille means mounted in front of the front panel, and a blow-off grille means disposed to a bottom of the casing in a vertical state and being continuous to said front panel, said blow-off grille means comprising:

a plurality of louvers turnable around axes thereof parallel to each other;

two link mechanisms operatively connected to said louvers so as to turn said louvers with different angles, respectively, said link mechanisms each comprising a plurality of link members which are turnably coupled with each other; and means for driving said link mechanism to thereby turn said louver means with different air blow-off open angles, respectively.

2. An air conditioner according to claim 1, wherein said louver means comprises two louvers, one being a main louver and another being a sub-louver and each of said link mechanism each comprises a five-knot link mechanism including a main link member, a sub-link member, a first coupling link member and a second coupling member, said main link member having one end connected to said main louver and another end turnably connected to one end of the first coupling link member, said first coupling link member having another end turnably connected to one end of the second coupling link member, said second coupling link member having another end turnably connected to one end of said sub-link member, said sub-link member having another end connected to said sub-louver.

3. An air conditioner according to claim 2, wherein said grille means further comprises an operation mode transfer means to transfer the operation mode of the louvers.

4. An air conditioner according to claim 3, wherein said operation mode transfer means comprises a spring member having one end connected to the main link member and another end connected to a connecting portion for said first and second coupling link member.

5. An air conditioner according to claim 3, wherein said operation mode transfer means comprises an engaging clutch member secured to a connecting portion for the main link member and the first coupling link member.

* * * * *